United States Patent [19]

Kim

[11] 4,106,777

[45] Aug. 15, 1978

[54] RIGIDIZED SHAFT CONSTRUCTION FOR SPORTS APPARATUS

[76] Inventor: Sung Baik Kim, 32-32 82nd St., Jackson Heights, N.Y. 11372

[21] Appl. No.: 765,995

[22] Filed: Feb. 7, 1977

[51] Int. Cl.[2] ..... A63B 53/12

[52] U.S. Cl. ..... 273/80 B; 52/737; 280/11.37 L

[58] Field of Search ..... 273/80 R, 80 B, 80.9, 273/73 F, 73 H; 43/18 R; 72/276, 414; 113/116 Y; 52/630, 720, 734–740; 280/11.37 L; 114/90; D34/5 GC, 5 GS

[56] References Cited

U.S. PATENT DOCUMENTS

| | | | |
|---|---|---|---|
| Re. 18,666 | 11/1932 | Morgan | 273/80 B |
| D. 236,639 | 9/1975 | Kanne | 273/80 R X |
| D. 236,735 | 9/1975 | Bush | 273/80 R X |
| D. 246,003 | 10/1977 | Shimada | D34/5 GS |
| 417,433 | 12/1889 | Lorenz | 280/11.37 B X |
| 456,646 | 7/1891 | Clark | 52/734 X |
| 1,169,667 | 1/1916 | Meguyer | 273/80 B |
| 1,218,091 | 3/1917 | Lard | 273/80 B X |
| 1,317,146 | 9/1919 | Welles | 273/80 B X |
| 1,848,374 | 3/1932 | Morgan | 273/80 R |
| 1,917,795 | 7/1933 | Fetter | 273/80 R |
| 1,983,074 | 12/1934 | Durell | 273/80 B X |
| 1,996,298 | 4/1935 | Lard | 273/80 R |
| 2,126,717 | 8/1938 | Barnhart | 273/80 B |
| 2,376,761 | 5/1945 | Fahy | 52/738 |
| 3,125,038 | 3/1964 | Amato | 52/738 X |
| 3,421,279 | 1/1969 | Franc | 52/630 X |
| 3,508,587 | 4/1970 | Mauch | 52/720 X |
| 3,516,670 | 6/1970 | D'Agostino et al. | 273/73 F X |
| 3,840,230 | 10/1974 | Schaefer et al. | 273/73 F |
| 3,972,529 | 8/1976 | McNeil | 273/80 B |

FOREIGN PATENT DOCUMENTS

| | | | |
|---|---|---|---|
| 1,236,074 | 1/1960 | France | 113/116 Y |
| 1,192,924 | 4/1959 | France | 43/18 R |
| 857,269 | 11/1952 | Fed. Rep. of Germany | 52/736 |
| 471,020 | 8/1937 | United Kingdom | 273/80 B |
| 10,721 of | 1904 | United Kingdom | 43/18 R |
| 385,241 | 12/1932 | United Kingdom | 273/80 R |
| 483,995 | 4/1938 | United Kingdom | 273/80 B |
| 1,313,751 | 4/1973 | United Kingdom | 273/80 B |

*Primary Examiner*—Richard J. Apley
*Attorney, Agent, or Firm*—Natter & Natter

[57] ABSTRACT

A tubular shaft for a golf club or similar sports apparatus having a rigidized construction. The tubular shaft wall has a three-dimensional textured surface pattern formed by a plurality of alternate areas of convexity and concavity extending on corresponding sides of a neutral longitudinal axis through the shaft wall. The material distribution provides increased resistance to vertical, horizontal and torsional stresses without additional weight.

9 Claims, 8 Drawing Figures

RIGIDIZED SHAFT CONSTRUCTION FOR SPORTS APPARATUS

BACKGROUND OF THE INVENTION

1. Field of the Invention

This invention relates to a tubular shaft construction and especially to a hollow shaft having alternate areas of surface convexity and concavity to provide integral reinforcement for increased rigidity.

The shaft construction of this invention is particularly adaptable for sports playing equipment having elongated or slender medial sections or handles such as for golf clubs, ski poles, squash rackets, and the like.

2. Description of the Prior Art

Sports apparatus as currently being manufactured is subjected to shock or impact stresses, and as a result must be designed to accommodate these varying load conditions. It is important in such sport activities as golf, skiing, tennis, etc., that the respective equipment, i.e. golf club, ski pole, tennis racket, be as light as practicable so that it can be easily handled, yet should be structurally capable of withstanding high impact blows.

Devices of the prior art, such as golf clubs were accordingly improved by substituting some of the previously used materials, e.g. wooden shafts, with tubular metal shafts having higher yield stresses and also by providing cross-sectional shapes that afforded maximum rigidity.

Other shaft constructions such as disclosed in U.S. Pat. Nos. 1,983,074 and 2,001,643 utilized longitudinal undulations or grooves formed in a cylindrical tubular shaft. In many of these shafts the grooves constituted ribs or corrugations extending from one end of the shaft to the other end. While these reinforcement systems offered added strength, they did so at the expense of additional weight, bulkiness, and cost. Furthermore, this previously disclosed construction is primarily concerned with strengthening the shaft along its vertical axis with minimum resistance strength being provided for torsional stresses.

In addition, attempts have also been made at stamping, corrugating or embossing a design which is pressed into the surface of the shaft, ostensibly for providing added rigidity, but in many cases merely improving only the esthetic appearance.

This invention overcomes many of the shortcomings of the prior art by providing a three-dimensional redistribution of the tubular material for increased structural rigidity without added weight.

SUMMARY OF THE INVENTION

Briefly, this invention concerns a tubular shaft construction having a three-dimensional textured surface pattern for increasing its strength and rigidity.

The shaft is preferably fabricated of a metal which is subjected to mechanical working for redistributing the material on opposite sides of a neutral longitudinal axis extending through the wall thickness. A plastic deformation is effected under compression and can take the form of a regular pattern of alternate protuberances and indentations having a variety of selected shapes. The surface pattern thus formed in relief will appear on both the outside and inside of the tubular wall. This differs from conventional stamping operations such as coining or embossing. In embossing a design is raised by using dies of a similar pattern with one die being the negative of the other. Coining on the other hand uses die halves of different configurations. Corrugated materials have ridges and valleys running in one direction only. Neither of these other systems provides reinforcement through a three-dimensional textured effect as in the instant invention.

Another benefit of this so formed textured surface is that it is optically flat and thus will substantially eliminate unwanted glare. Additionally, this surface treatment improves the general appearance of the golf shaft by hiding scratches and scars and will appreciably reduce the amount of ordinary care and cleaning that may be required.

Having thus summarized the invention, it will be seen that an object thereof is to provide a rigidized shaft construction for a golf club or like article of the general character described herein.

Specifically, it is an object of this invention to provide a rigidized shaft construction having a three-dimensional redistribution of the tubular material for increasing its structural rigidity.

Another object of this invention is to provide a rigidized shaft construction having a textured pattern formed by alternate areas of surface convexity and concavity extending respectively both internally and externally from a neutral longitudinal axis passing through the tubular wall.

A still further object of this invention is to provide a rigidized shaft construction having a textured surface pattern which integrally reinforces the shaft for resistance to longitudinal as well as torsional stresses.

Yet another object of this invention is to provide a rigidized shaft construction having a textured surface pattern which aesthetically improves the appearance of a golf club and reduces reflected glare.

These and other objects, features and advantages of this invention will be apparent from the following description of the preferred embodiment when considered in connection with the accompanying drawings.

BRIEF DESCRIPTION OF THE DRAWINGS

In the accompanying drawings in which are shown the preferred embodiments of this invention.

DESCRIPTION OF THE INVENTION

Figure 1:
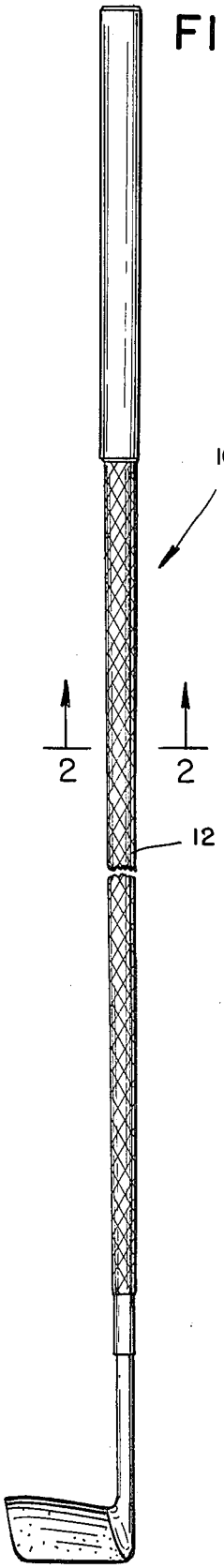
FIG. 1 is a front view of a portion of a tapered rigidized shaft of this invention as applied to a golf club.
Figure 2:
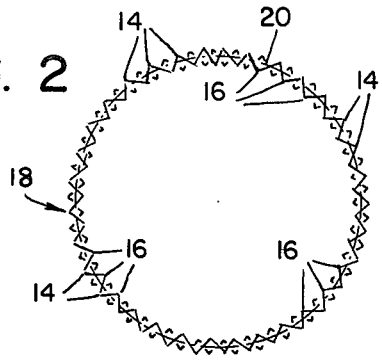
FIG. 2 is a schematic cross-sectional view showing a tubular wall to an enlarged scale as taken substantially along line 2—2 of FIG. 1.

Referring now in detail to the drawings, the reference numeral 10 denotes generally a rigidized shaft of this invention as incorporated in a golf club. As illustrated in FIGS. 1 and 2, the shaft 10 has a tapered tubular wall 18 and is preferably fabricated of metal such as aluminum, high carbon steel, titanium, etc., however it can also be made of thermoplastic material. Additionally, the shaft 10 can be formed in a cylindrical, step-down or other desired configuration in accordance with the particular application. In the context of this description the shaft 10 will be referred to as forming an integral part of a golf club; however it should be understood that other similar uses would apply such as for ski poles, tennis rackets, squash rackets, and the like.

Figure 3:
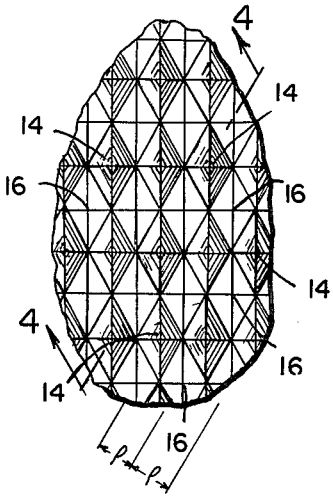
FIG. 3 is an isolated view of a portion of the wall surface taken to an enlarged scale and showing the surface contours.
Figure 4:
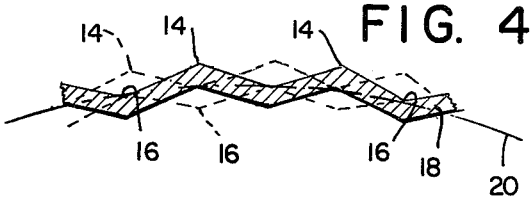
FIG. 4 is a sectional view taken substantially along line 4—4 of FIG. 3 showing the areas of convexity and concavity above and below a neutral axis.

As noted in FIGS. 1 and 3, the shaft 10 is provided with a textured surface 12 represented by the diagonal cross-hatching. This textured surface has a plurality of convexities and concavities in the form of a regular pattern of raised pyramidal peaks 14 and alternate corresponding recesses 16 being the reverse image of the peaks 14. The peaks 14 and recesses 16 extend respectively both exteriorly and interiorly from a neutral planar axis 20 passing circumferentially through the tubular wall 18. As shown in FIGS. 2 and 4, in adjacent neutral planar axes, each spaced apart a pitch distance "*p*" from one another, which axes are parallel to the neutral axis 20, the relative positions of the peaks 14 and recesses 16 are reversed.

Figure 5:
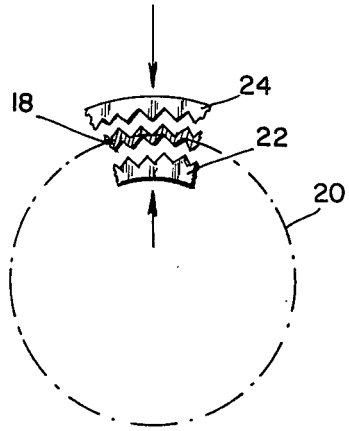
FIG. 5 is a diagramatic representation of the metal compression process for forming the textured surface.

The textured surface 12 is formed by redistribution of the tubular wall 18 with respect to the neutral axis 20. In accordance with this invention such redistribution is accomplished typically by the application of synchronized sets of compression dies. The tubular wall 18 can be manufactured by an extrusion process forming a cylindrical tube which can then be swaged for taper and for step-down. Thereafter, the textured surface 12 can be applied. In FIG. 5 a section of the tubular wall 18 is shown schematically after the extruding process wherein a collapsible core or mandrel is provided with a die 22 which coacts by movement toward an exterior mating die 24 as indicated by the arrows shown in the drawing. The simultaneous compressive forces thus applied by dies 22, 24 cause a plastic deformation and resultant redistribution of the tubular wall 18 and will produce the desired textured surface 12. Alternately, mechanical working of the metal can be performed while in flat sheets; these sheets can then be cut, rolled and seamed, as by welding or lap seaming to form tubular sections.

It should be noted that as a result of this material redistribution above and below the neutral axis 20 a rigidizing effect is produced for increasing the structural strength of the shaft 10 without the addition of more weight. The textured surface pattern 12 is considered three-dimensional in that the tubular material 18 is redistributed in three separate and parallel planes, one plane being defined by the locus of peaks 14, another plane being defined by the locus of recesses 16, and the third plane lying along the neutral axis 20. The effect of this redistribution is integral reinforcement and strengthening of the tubular wall 18 against forces applied in any direction or applied along any axis including torsional forces.

Furthermore, the textured surface 12 provides a finish that is relatively maintenance free and optically flat for reducing undesirable reflected light and glare. When this shaft 10 is used as a golf club, it will provide the necessary elasticity and flexibility yet have greater strength resistance to torsional stresses.

Figure 1A:
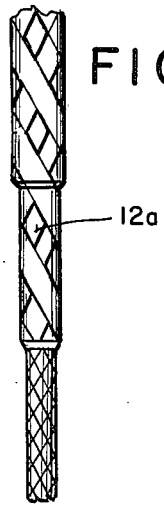
FIG. 1*a* is a partial view of an alternate embodiment showing a step-down tapered rigidized shaft of this invention.
Figure 2A:
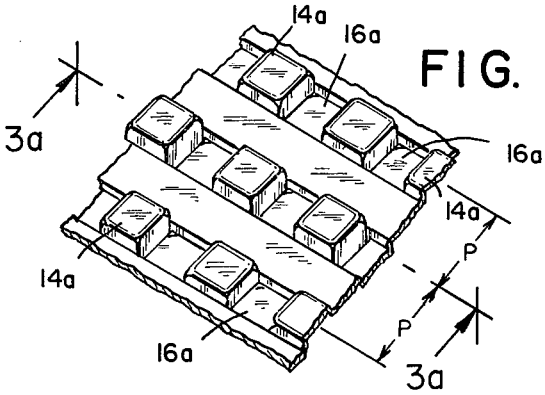
FIG. 2*a* is an isolated view of a portion of the wall surface taken to an enlarged scale and showing the surface contours of the alternate embodiment.
Figure 3A:
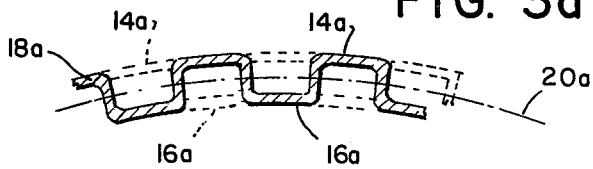
FIG. 3*a* is a sectional view taken substantially along line 3*a*—3*a* of FIG. 2*a* showing the projections and depressions above and below a neutral axis.

A variant embodiment is illustrated in FIGS. 1*a*, 2*a* and 3*a*, wherein corresponding reference numerals denoted by the letter "*a*" designate similar elements in the second embodiment. FIG. 1*a* shows a partial view of a step-down rigidized shaft 10*a* having a three-dimensional textured surface pattern 12*a*. This textured surface 12*a* has a plurality of angular shaped projections 14*a* and corresponding depressions 16*a* as denoted to an enlarged scale in FIG. 2*a*. Each of the projections 14*a* and depressions 16*a* results from a redistribution of a tubular wall 18*a* about a neutral axis 20*a*. FIG. 3*a* illustrates a typical section through the textured surface 12*a*. It should be noted that alternating courses of projections 14*a* and depressions 16*a* extend along neutral axes which are oriented obliquely to the longitudinal axis of the shaft 10*a*. This configuration provides increased shaft torsional strength which is desirable in certain sporting implements such as golf clubs wherein shafts are subjected to torsional impact stress.

It should be apparent that numerous designs can be used and further that the shaft may also contain an untextured surface area or a combination of different textures such as 12 and 12*a* on the same shaft.

The above described embodiments are therefore intended as exemplary; while they have described the invention with specific implementations thereof, further modifications and changes may be apparent to those skilled in the art. It should therefore be understood that all material shown and described in the accompanying drawings is to be interpreted as illustrative and not in a limiting sense.

Having thus described the invention, there is claimed as new and desired to be secured by Letters Patent:

1. A tubular shaft suitable for use in a sports implement, said shaft comprising an elongate peripheral wall, the wall extending about a longitudinal axis, and integral shaft reinforcement means, the reinforcement means including means configuring the peripheral wall in a textured pattern comprising a plurality of equidistantly spaced first areas along a selected neutral planar axis, the plane of which intersect the longitudinal axis, the peripheral wall projecting outwardly beyond the selected neutral axis in the first areas, and a plurality of equidistantly spaced second areas along the selected neutral axis and occupying the spaces between the first areas, and wherein the peripheral wall projects inwardly from the selected neutral axis, the textured pattern further including a plurality of further first and second spaced areas along a second neutral axis adjacent and parallel to the selected neutral axis, wherein the first and second areas of the peripheral wall at the second neutral axis are staggered with respect to the first and second areas of the selected neutral axis.

2. A tubular shaft constructed in accordance with claim 1 further including a plurality of parallel neutral axes equidistantly spaced along the longitudinal axis a predetermined pitch distance, the first and second areas of the peripheral wall at each neutral axis being staggered with respect to the first and second areas of the peripheral wall at each adjacent neutral axis.

3. A sports implement constructed in accordance with claim 1 further including handle means at one end of the tubular shaft and means adapted for physical contact during a sporting activity fixed to the opposite end of the shaft.

4. A sport implement constructed in accordance with claim 3 wherein the means adapted for physical contact includes means adapted to strike a golf ball.

5. A tubular shaft constructed in accordance with claim 1 wherein the shaft is formed of metal.

6. A tubular shaft constructed in accordance with claim 1 wherein the first and second areas are pyramidal in form.

7. A tubular shaft constructed in accordance with claim 1 wherein the first and second areas are regular polygons in plan configuration.

8. A tubular shaft constructed in accordance with claim 1 wherein the planes of the neutral axes intersect the longitudinal axis obliquely, whereby torsional strength is greatly enhanced.

9. A rigidized shaft construction as claimed in claim 1 having at least two separate and discrete textured surface patterns on the same shaft.

* * * * *